Figure 1:
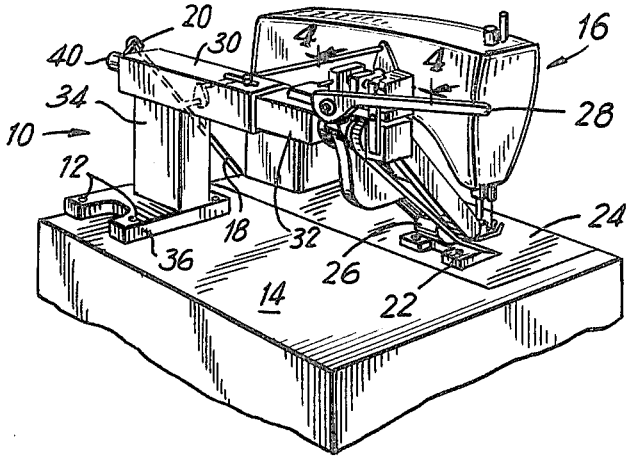

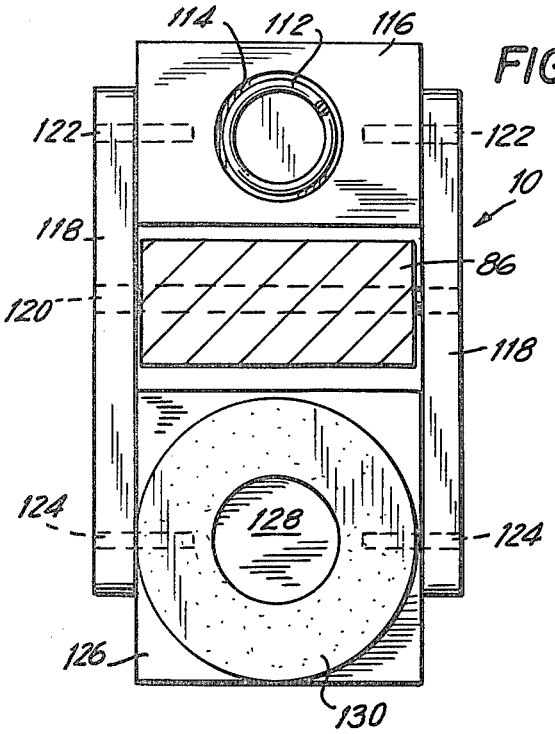
FIG.5
FIG.9
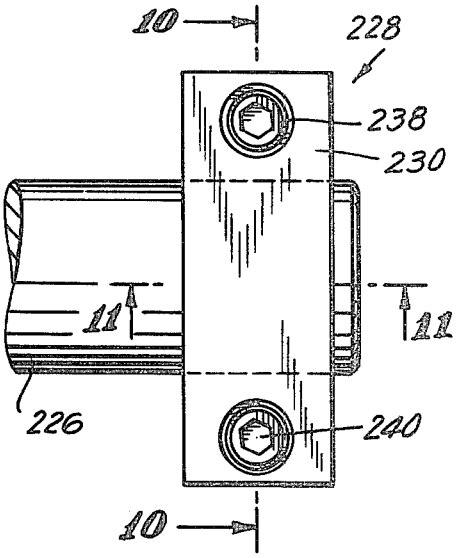
FIG.10
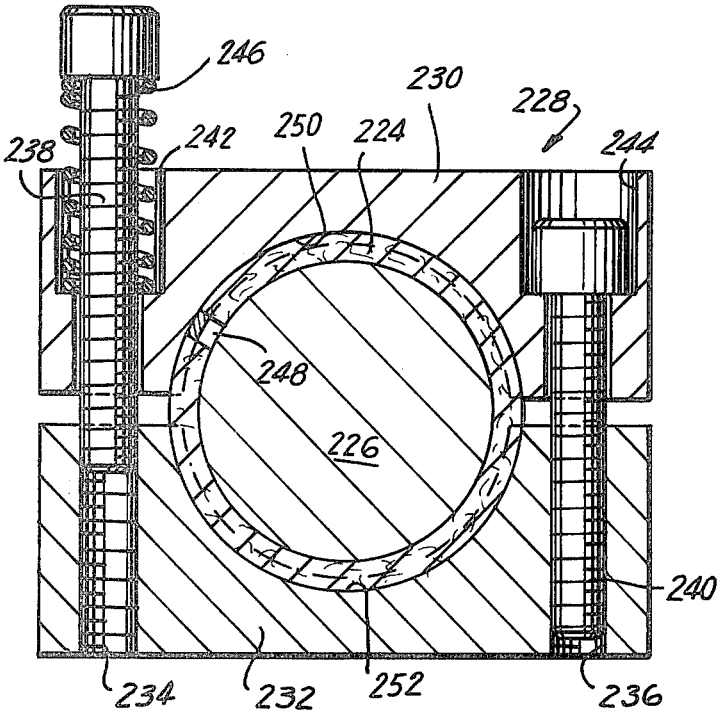
FIG.11
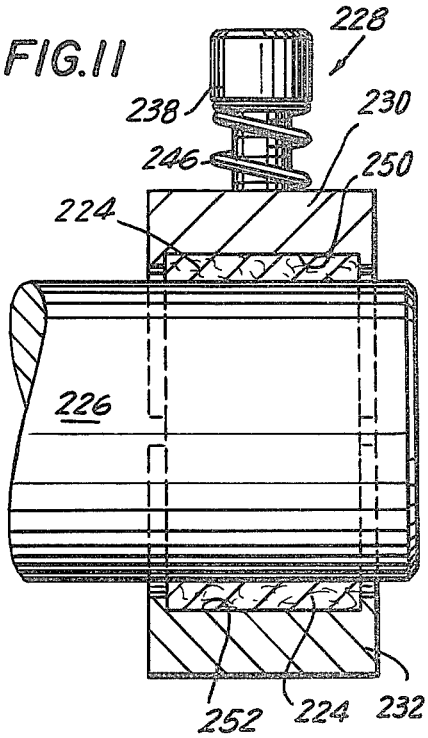

HIGH SPEED INDEXING SYSTEM

The present invention relates generally to apparatus used to move and perform functions upon fabric, or the like, and more particularly to a system capable of providing the user with relatively high-speed, reliable indexing of same, such as in association with pullers, as an example.

BACKGROUND OF PRIOR ART PROBLEMS

As has been stated in prior art patents and in industry literature, the sewing machine industry has consistently sought ways by which to increase both sewing speeds as well as the speeds with which fabrics can be handled. Higher speeds, with associated higher product output, especially in the industrial marketplace, will result in higher profits.

Traditional types of aids or sewing machine accessories, include the puller, which was invented in 1934 by Joseph Galkin and his associates, and which has been marketed since by the Joseph Galkin Corporation. Pullers have been used to overcome a natural deficiency in the way a sewing machine feed dog moves multiple layers of cloth or fabric. It is known that the feed dog will tend to push the lowest layer of cloth or fabric while the machine presser foot tends to retard the forward movement of the upper layer of cloth, with the result that the cloth must be dragged under and against the stationary presser foot. This drag causes the upper layer to slip with respect to the lower layer, with the result that a progressive loss of alignment is realized as the seam is sewn. The longer the seam, the worse this problem becomes.

Pullers are also useful in feeding heavier materials where conditions are such that top and bottom layers may slip. Various schemes have been devised to overcome the problem, such as "walking" presser feet, the substitution of a roller for the presser foot, and pulling mechanisms of the type disclosed in U.S. Pat. No. 3,960,097 granted on June 1, 1976 and entitled High Speed Gearless Fabric Puller. Other U.S. Patents that may be of interest include U.S. Pat. Nos. 2,037,088; 2,231,648; 3,083,658; and 3,141,428. The reader is also referred to British Pat. No. 528,684.

While the present invention should in no way be construed as being limited to pullers but, on the contrary, is usable in concept with any type of indexing mechanism wherein inertia problems exist, it will be helpful to the reader to set forth here some of the background of this area in the industry.

Pullers may be classified in several ways, the most important factor being whether the rollers are driven continuously by the sewing machine during the sewing operation, or intermittently in synchronism with the feed dog. Another variable is the manner in which the rollers are driven. On some rollers, only the upper roller is driven; on others the lower roller only is driven; and on superior units both rollers are used to advance the cloth or fabric. In all of these cases, the speed at which the puller can function satisfactorily is critical.

Continuously driven pullers, as opposed to synchronized pullers, have been in the past most useful on light and flexible fabrics where the fabric is able to stretch to compensate for the fact that the feed dog feeds the fabric intermittently and only when the needle is out of the fabric, while the puller is feeding the fabric continuously. Obviously, the fabric must stretch while the needle is in the cloth and the foot is not feeding. If the fabric is unable to stretch, the cloth will slip. Slipping may occur at the feed dog or at the puller rolls or, in some cases, at both places. When the cloth slips at the feed dog, the needle which is in the cloth at the time will bend and may break by rubbing against the needle plate or other machine part. Needle damage of this sort can be alleviated by increasing the presser foot pressure, and reducing pressure on the puller rolls. However, this will cause slipping to take place at the puller such that the puller will be unable to perform its functions satisfactorily.

Synchronized pullers tend to solve the problem of stretching or slipping of cloth by utilizing feed rolls that are moved intermittently in unison with the feed dog. Since the cloth is not being pulled when the needle is in it, slippage or stretching is not required. However, at relatively higher speeds, yet another problem comes into play, which concerns itself with the inherent inertia of the mechanism being utilized to handle and perform functions on the fabric.

By the term "inertia", what is referred to is the natural tendency of the actual physical mechanism employed in moving the fabric to resist both acceleration and deceleration. This problem manifests itself during attempts to cause puller feed rolls to advance intermittently every time a stitch is taken. The rollers and the rest of the associated puller mechanism must be started and stopped. This is more of a problem in the stopping of the feed rolls positively, as opposed to the starting of the rolls. When the rolls are moved at higher speeds, one experiences the consequences of Newton's law wherein the difficulty of stopping the feed rollers increases as a function of the square of the operating speed. As long as one is sewing at relatively slower speeds—for example, under 1,500 stitches per minute (spm)—conventional puller designs do not have too much trouble in stopping. However, at the upper spectrum of relatively higher operating speeds, if we double the speed one experiences the difficulty of stopping the rolls which is perhaps four times harder.

If puller feed rolls are not stopped substantially precisely at the end of each feed dog's cycle, the feed roll overshoots or, in more common parlance, turns a bit more than desired. This additional turning, while small, occurs erratically and will vary with speed and puller adjustment. The result is the undesirable varying of stitch size and slipping.

Efforts to deal with this problem have in many cases resulted in operating at speeds far below the speed capability of the sewing machine being employed. Until developments such as that disclosed within U.S. Pat. No. 3,960,097, running at relatively slower speeds was a choice chosen by most in the industry. And yet, a growing need exists for machine speeds of 6,000 to 8,500 stitches per minute, as opposed to conventional speeds of 3,500–4,000 stitches per minute.

Accordingly, it is an object of the present invention to provide an adjustable high-speed indexing system capable of use with any number of different rotating apparatus wherein inertia problems interfere with high speed indexing.

Another object of the present invention is to provide an adjustable high speed indexing system wherein, by knowing the running speed of a customer's sewing machine, appropriate parameters can be calculated so as to adjust the spring pressure certain braking means within the system.

held integral with shaft 38 by means of setscrews 78 which lock them together.

Roller 26 is maintained against the idler roller of idler roller assembly 22 by means of a helical compression spring 80 which bears against the upper surfaces of horizontal leg 52 and lower surfaces of a block member 82. The position of block member 82 is controllable by means of adjusting bolt 84, thereby making variable and adjustable the pressure of roller 26 against the idler roller. Adjusting bolt 84 is carried by a horizontal support plate 86, which is bolted to extension 32 by bolts 88. Before looking at other portions of this invention carried by support plate 86, it is worth mentioning that roller 26 may also be lifted by means of a linkage interconnected with the foot pedal normally used to raise the presser foot of the sewing machine. A linking member 90 interconnects a boss 92 formed in extremity 60 of horizontal leg 52 and a rotatable wing plate 94 supported from extension 32. Wing plate 94, in turn, provides the link with a connecting rod 96 which, by means of plate 98, comprises a linkage interconnecting support member 48 with the machine foot pedal. Roller 26 may be lifted by means of lifting handle 28 or the linkage just described, or both.

Figure 4:
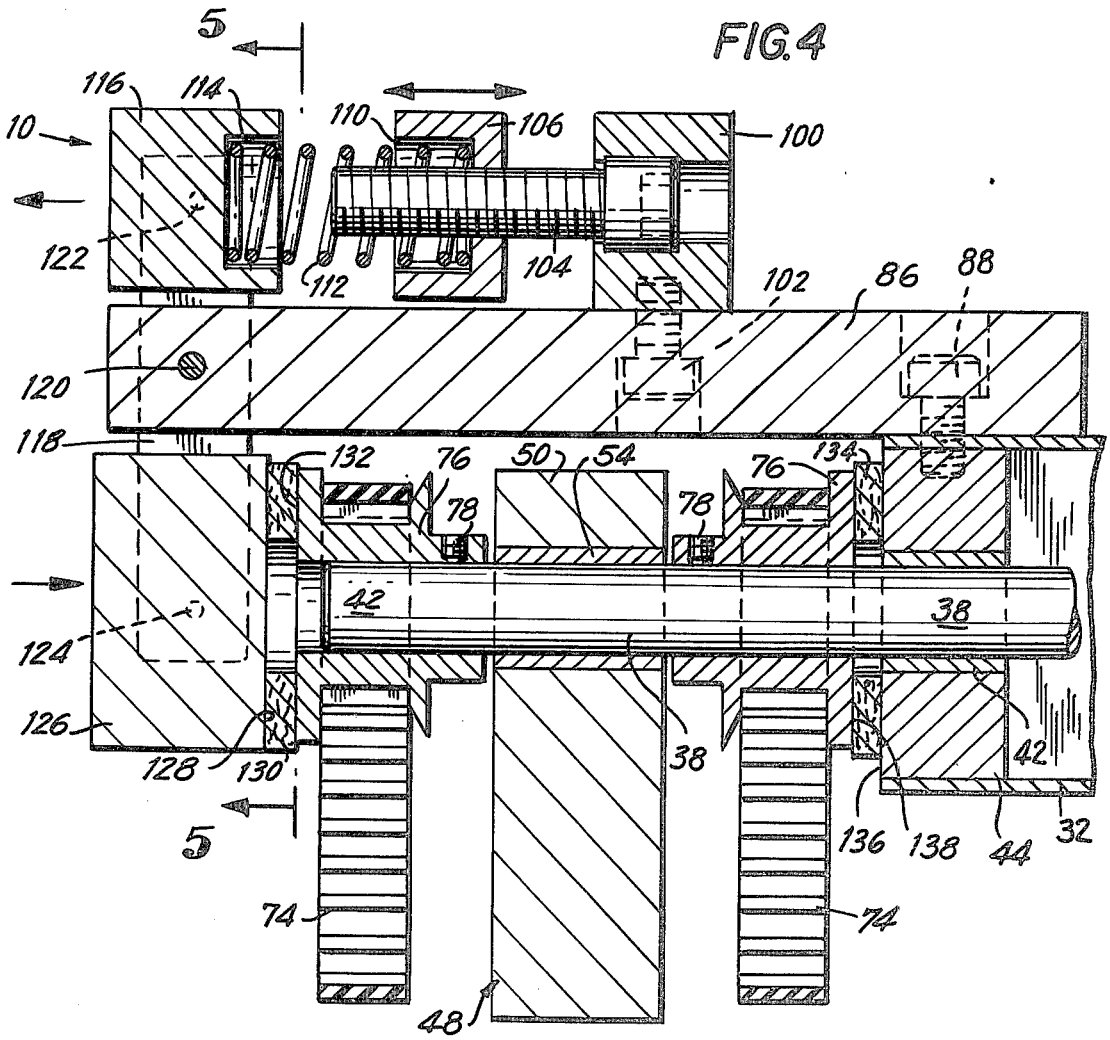
Figure 2:
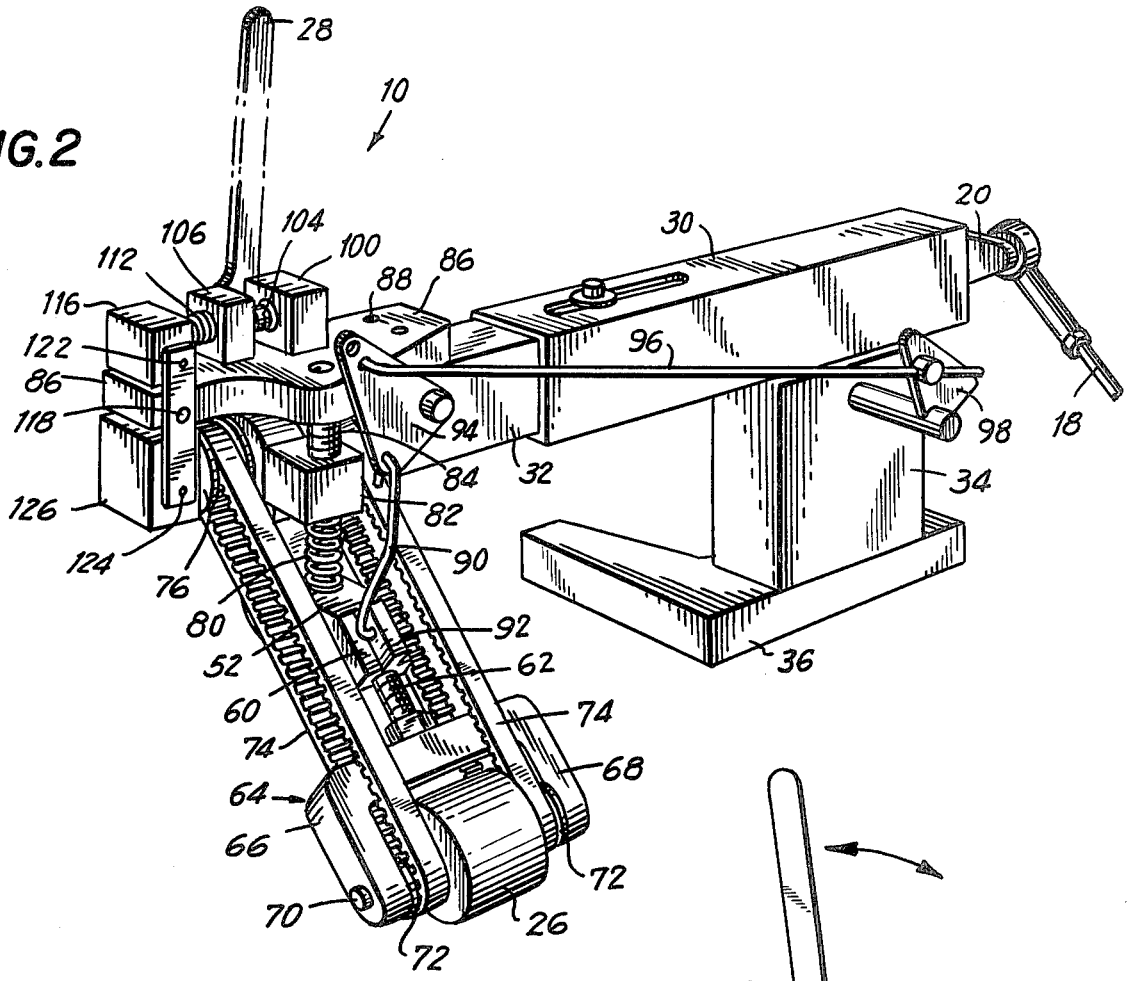
Figure 3:
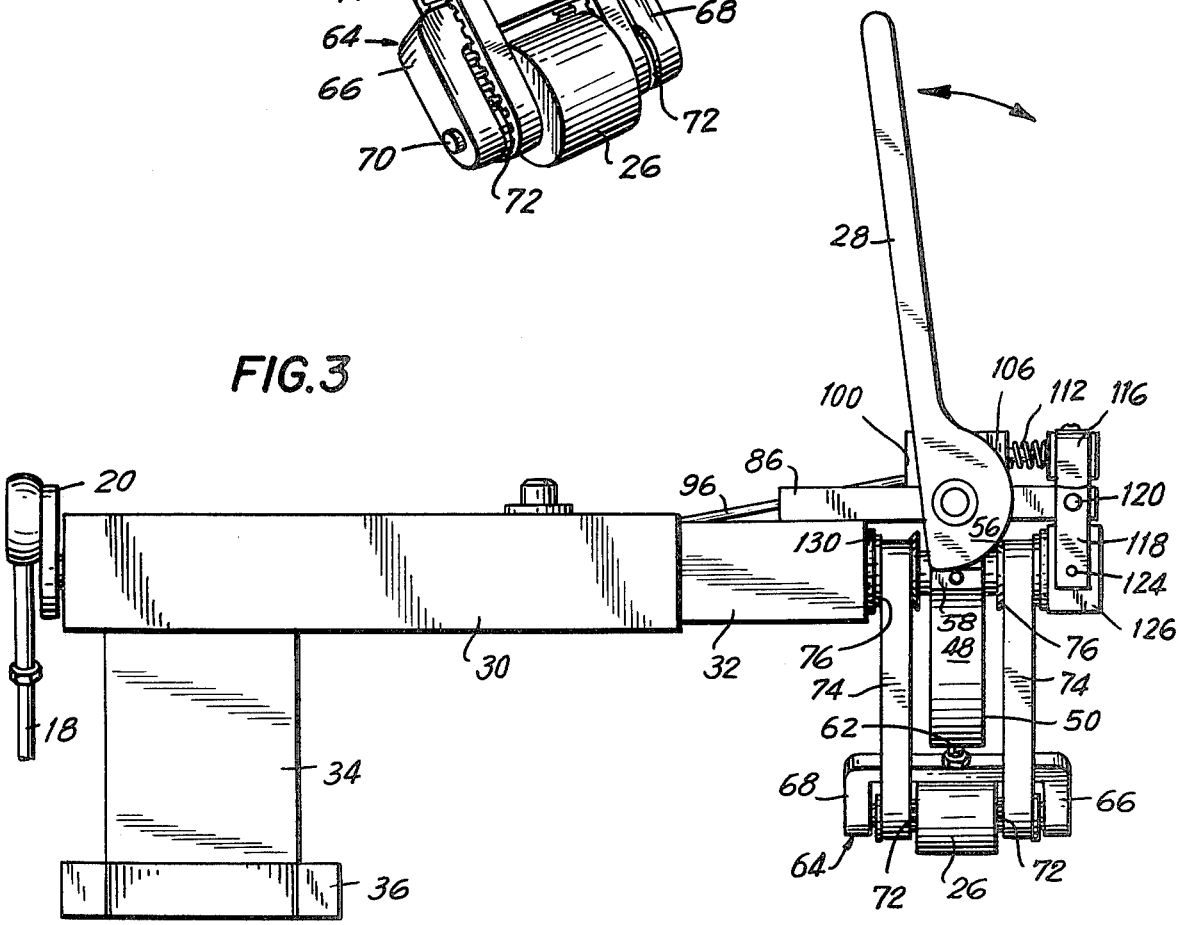

Turning now once again to support plate 86, it can be seen in FIG. 4 that a block 100 is rigidly held integrally with and atop plate 86 by means of any one or more bolts 102. The head of an adjusting bolt 104 is supported within block 100 such that bolt 104 extends substantially horizontally above plate 86. A cup-shaped member 106 is formed with internal threads 108 which are threadedly carried by the external threads of the bolt 104. A recess 110 within member 106 houses one end of a helical spring 112, the opposite end of spring 112 being held within recess 114 of an opposing cup-shaped member 116. With the head of bolt 104 restrained from horizontal movement but permitted to rotate, rotation of bolt 104 in opposite directions will result the movement of member 106 in the direction of the arrows above it, thereby facilitating relatively precise control of the compressive forces of spring 112.

A pair of link members 118 are pivotally supported on a central pin 120 extending through support plate 86. Upper and lower pins 120 and 124 interconnect link members 118 on either side of the support plate 86 with cup-shaped member 116 and a bearing block 126 situated below plate 86. Bearing block 126 includes a vertical face 128 against which a braking disc 130 is exposed. Braking disc 130 is situated between face 128 and bearing surfaces 132 of sprocket wheel 76, and the disc is preferably adhered to a predetermined area of face 128 to enable the transfer and dissipation of heat generated within disc 130 during use. A second braking disc 134 is secured to face 136 of block 44 and, in much the same manner, bears against surfaces 138 of opposite sprocket wheel 76.

During rotation of shaft 38, sprocket wheels 76 which are integral therewith rotate with the shaft against the retarding friction forces caused by the presence of braking discs 130 and 134 bearing against their surfaces 132 and 138. The magnitude of these friction or drag forces is adjustable by means of rotation of bolt 104 which, when turned to cause increasing compressive forces within spring 112, will cause a movement of member 116 to the left as seen in FIG. 4, such that as a result of link members 118, bearing block 126 will move to the right as seen in the same FIG. 4, thereby causing increasing drag forces as a result of the pressure between braking discs 126 and 130. Decreases in these drag forces is accomplished by turning adjusting bolt 104 in the opposite direction.

In use, knowing the machine operating speeds of a customer who wishes to purchase puller attachment 10, one can adjust the pressure exerted by braking discs 130 and 134 by means of manipulating adjustment bolt 104, as just described. With the proper adjustment, a predetermined and adjustable drag or braking force is applied to shaft 38 and its associated hardware such that undesirable inertia-caused overshooting which would otherwise result when the drive mechanism stops is virtually eliminated. Speeds in excess of 6,000 stitches per minute are realizable with the present invention in a synchronized indexed adjustable system which can be adjusted for adjustable indexing as well. In addition, self-adjustment is realized in instances where the wear of braking discs 130 and 134 might otherwise cause a substantial decrease in braking pressure. In such instances, the compressive forces of helical spring 112 will automatically compensate for this wear allowance. More importantly, the braking system taught by this invention may be used with any indexing device, as will become apparent in the following discussion.

Figure 6:
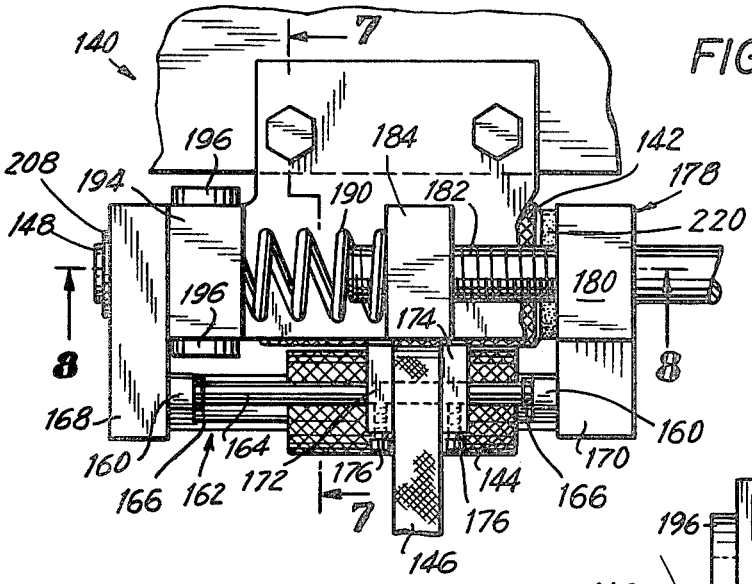
Figure 7:
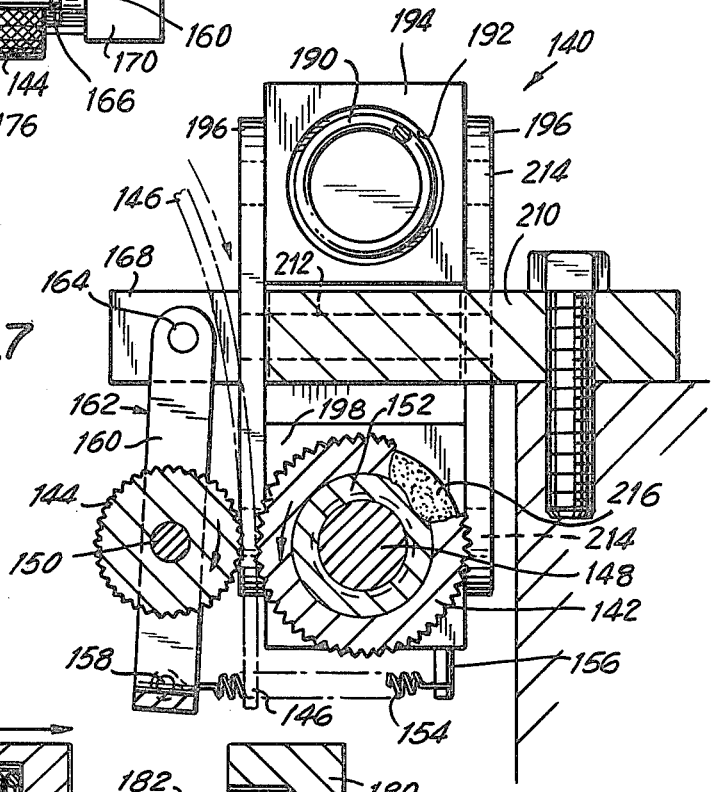
Figure 8:
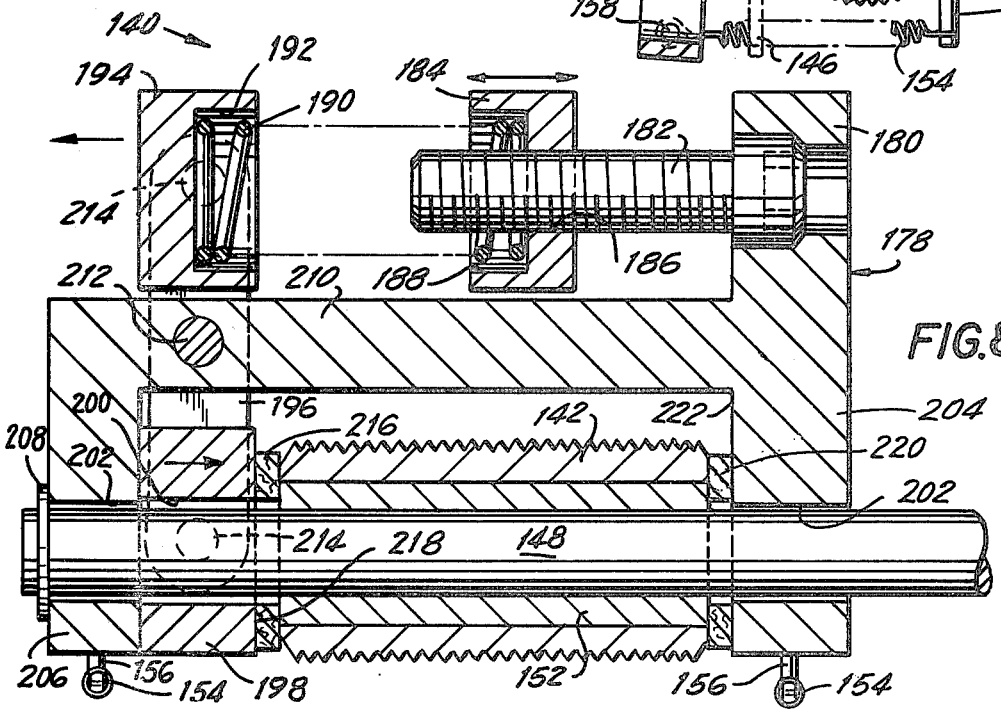

FIGS. 6, 7 and 8, illustrate in another embodiment of the present invention, a metering device in which is a high-speed synchronized system that will actually meter elastic, lace, ribbon, webbing, binding, waist bands and other materials at speeds in excess of 6,000 cycles or stitches per minute. Extremely accurate length matching on both stretch and non-stretch type materials is achieved with this high-speed synchronized metering device identified by reference character 140 in FIGS. 6, 7 and 8. A pair of knurled rollers 142 and 144 engage and feed elastic material 146, for example, in the direction shown by the arrow in FIG. 7 when rollers 142 and 144 rotate in the directions likewise shown in this figure. Roller 142 is carried by a shaft 148, while roller 144 is carried by shaft 150. In a preferred embodiment of this invention, a one-way ratchet or other type clutch 152 lies within the inner diameter of roller 142, such that this driven roller is able to rotate in only one direction—that of the direction of feeding of the material 146. Roller 144, on the other hand, is an idler roller which is biased toward roller 142 by means of a pair of helical springs 154 supported by pins 156 and 158, respectively.

Roller 144 and its supporting shaft 150 are carried by and between legs 160 of a U-shaped support 162. Legs 160 are journaled about a connecting shaft 164 which, in turn, is supported within sleeve bearings 166 carried by opposing support blocks 168 and 170. Guide plates 172 and 174 are independently adjustable along the length of shaft 164 such that material 146 of varying widths may be accommodated. Guide plates 172 and 174 are held in their respective desired positions by means of knurled-headed adjusting bolts 176. Thus, as best seen in FIG. 7, support 162 its associated roller 144 may be pivoted about shaft 164 toward or away from roller 142 against the tensile biasing forces of helical spring 154. This facilitates access to material 146 between the rollers and adjustment or feeding of the material there between.

A frame member 178 comprises the basis of support for metering device 140. In a preferred embodiment of this invention, frame member 178 consists of a one-piece casting of which support blocks 168 and 170 are an integral part. As best seen in FIG. 8, frame member 178 includes an outwardly projecting block portion 180 within which the head of an adjusting bolt 182 is journaled.

Adjusting bolt 182 carries a cup-shaped member 184, which is formed with both internal threads 186, cooperative with the external threads of bolt 182, and a recess 188 within which the end of helical spring 190 is situated. The opposite end of spring 190 is situated within a recess 192 formed in cup-shaped block 194.

Member 184 is "floating" in that rotation of bolt 182 will result in forward and rearward movement of member 184 along the shank of bolt 182. In this way, spring 190 is either compressed or elongated, thereby facilitating manipulation of and predetermined adjustment of the compressive forces within and exerted by spring 190.

Link members 196 interconnect block 194 with a bearing block 198 disposed coaxially with respect to shaft 148. Shaft 148 extends through an opening 200 through block 198 and is carried in bearings 202 within legs 204 and 206 of frame 178. A conventional retaining ring 208 holds shaft 148 in place.

Link members 196 are pivotally supported on the sides of a platform 210 of frame number 178. A shaft 212 interconnects and pivotally supports link members 196 and is shown in FIG. 8, extending through platform 210. Pins 214 interconnect link members 196 with blocks 194 and 198. Thus, compressive forces of spring 190 which bias block 194 to the left as shown in FIG. 8, causes block 198 to move to the right about the axis of shaft 212.

Block 198 carries a braking disc 216 which is preferably adhered to the face 218 of block 198. An opposing braking disc 220 is affixed to face 222 of leg 204 and these braking discs are biased against the end surfaces of roller 142 as a result of the forces exerted by helical spring 190.

It will now be clear that rotation of adjusting bolt 182 in a direction which compresses spring 190 (as a result of the movement of cup-shaped member 184) will result in increasing braking or drag forces exerted by discs 216 and 220 against the surfaces of roller 142, with the result that increased drag will tend to overcome an adjusted and predetermined magnitude the otherwise undesirable overshooting which occurs at higher running speeds.

FIGS. 9, 10 and 11 illustrate another approach according to the present invention wherein the braking or adjustable drag used to accomplish the high-speed indexing is accomplished using friction about and directly on a shaft itself. In other words, as opposed to utilizing parallel directional compressive spring forces through a linkage to cause discs to come into contact with rotating parts, as already described above, a braking sleeve 224 is employed in wrapped relationship about shaft 226 itself. Braking assembly 228, in addition to braking sleeve 224, comprises a pair of opposing block members 230 and 232. Block members 230 and 232 basically comprise two halves or opposing parts of what becomes a unitary assembly, designated reference character 228. Block 232 is formed with a pair of capped holes 234 and 236 into which a pair of bolts 238 and 240 respectively, extend.

Counterbored holes 242 and 244 formed through block member 230 accept bolts 238 and 240. In the case of bolt 238, a helical spring surrounds this bolt and, under compression, bears against the underside of the head of bolt 238 and the shoulder between the diameters of opening or hole 242.

Braking sleeve 224 consists of a split member wrapped around shaft 226, with a gap 248 defined by the proximate ends of sleeve 224. Sleeve 224 may be placed within the concave cavities 250 and 252 in the manner whereby the gap 248 is located to give either uniform or non-uniform drag results about the surface of shaft 226.

It is important to note here that, while not specifically shown in the drawings, shaft 226 is preferably, but not necessarily, integral with and cooperates with a one-way clutch that causes shaft 226 to move in an intermittent manner in unison with the movement of a sewing machine feed dog, for example. With machine speeds increasing in excess of those conventionally enjoyed, overshooting is eliminated by means of braking assembly 228 by the user having available to him the ability to adjust by means of turning bolt 238 the compressor forces within spring 246, such that a controlled accurate adjustment of the friction or drag of sleeve 224 on shaft 226 is realized. Tightening of bolt 238 into tapped opening 234 will increase the compressor forces within spring 246 such that a clamping-type action is enjoyed and sleeve 224 is urged against shaft 226 by the surfaces defining cavities 250 and 252. Loosening of bolt 238 accomplishes the opposite result.

It is to be noted that the embodiment of our invention shown in FIGS. 9–11 is especially, though not necessarily, suited in instances where the intermittently-driven shaft may simply be extended to permit an exposed area of drag contact. We wish to further point out that this invention contemplates a number of different arrangements whereby the clutch means providing one-way motion may be located within or adjacent rollers, distant from rollers, or in other cooperative physical relationship with respect to the driven rollers.

The embodiments of the invention particularly disclosed and described are presented merely as examples of the invention. Other embodiments, forms and modifications of the invention coming within the proper scope and spirit of the appended claims will, of course, readily suggest themselves to those skilled in the art.

What is claimed is:

1. Fabric handling apparatus capable of moving fabric in successive high-speed indexed steps such as in connection with sewing operations, or the like, comprising, in combination: driving means, means responsive to said driving means for performing at least one function with fabric, clutch means disposed at a distance from said driving means for converting input motion from said driving means to substantially intermittent rotational output motion of a shaft member in a single rotational direction only, said shaft member having an otherwise undesirable tendency to exhibit overshooting movements due to its associated inertia load, indexing means cooperative with said clutch means for controlling the magnitude of said single-direction rotational movement of said shaft member, and adjustable brake means associated with said shaft member for retarding said undesirable inertia-caused overshooting movements of said shaft member during operation thereof, thereby facilitating relatively high-speed substantially reliable indexing of said rotating apparatus, said brake means comprising at least one friction member disposed in contact with rotating a surface associated and movable with said shaft member, spring means normally biasing said friction member against said surface, and adjustment means for selectively controlling pressure between said friction member and said surfaces, said spring means being spaced from and disposed in substantially parallel functional relationship with respect to the axis of said shaft member, forces from said spring means being transmitted to said friction member through a linkage arrangement.

2. Apparatus according to claim 1, wherein said brake means comprises a pair of spaced friction members.

3. Apparatus according to claim 1, wherein said brake means comprises a unitary drum-like friction member extending arcuately about said shaft member such that its extremities are spaced from one another.

4. Apparatus according to claim 1, further comprising heat sink means for drawing heat from said friction member.

5. Apparatus according to claim 1, wherein said shaft member comprises a shaft on which a roller is carried, said roller being adapted to contact and move fabric in an indexed intermittent movement in unison with steps in said sewing operation.

* * * * *

United States Patent [19]

Yoneji et al.

[11] 4,182,252

[45] Jan. 8, 1980

[54] CONTROL SYSTEM FOR A SEWING MACHINE

[75] Inventors: Satoshige Yoneji; Yoshiharu Higuchi; Shushin Mori, all of Nagoya, Japan

[73] Assignee: Brother Kogyo Kabushiki Kaisha, Nagoya, Japan

[21] Appl. No.: 879,107

[22] Filed: Feb. 17, 1978

[30] Foreign Application Priority Data

Feb. 18, 1977 [JP] Japan ..... 52/17433

[51] Int. Cl.[2] ..... D05B 69/18; D05B 69/20

[52] U.S. Cl. ..... 112/317

[58] Field of Search ..... 112/210, 121.11, 277, 112/300, 203, 316, 317

[56] References Cited

U.S. PATENT DOCUMENTS

| | | | |
|---|---|---|---|
| 3,750,603 | 8/1973 | Martin | 112/300 |
| 4,080,914 | 3/1978 | Ishida et al. | 112/277 |

*Primary Examiner*—Peter Nerbun

*Attorney, Agent, or Firm*—Browdy and Neimark

[57] ABSTRACT

A control system for a sewing machine includes at least an impulse generating circuit and a counter means connected thereto. A shift register having at least four bits and a mode selecting circuit connected thereto is provided. A circuit for feeding the work material or fabric forwards, a circuit for feeding the work material backwards, and a circuit for resetting these circuits are provided. The system is:

(1) capable of selecting, in advance, the number of stitches in a single forward and backward reciprocal non-ravel seaming;

(2) capable of doing a desired number of the repeated non-ravel seaming on a certain place (repeated reciprocal non-ravel seaming mode); and (3) capable of free selecting between the conventional non-ravel seaming mode and the above-mentioned repeated non-ravel seaming mode (the free mode selection). The selection is between the mode wherein a single starting non-ravel seaming and a single finishing non-ravel seaming are executed on the opposite ends of an ordinary straight seaming in the middle and the other mode wherein the above-mentioned repeated non-ravel seaming is executed at a desired number of repetition.

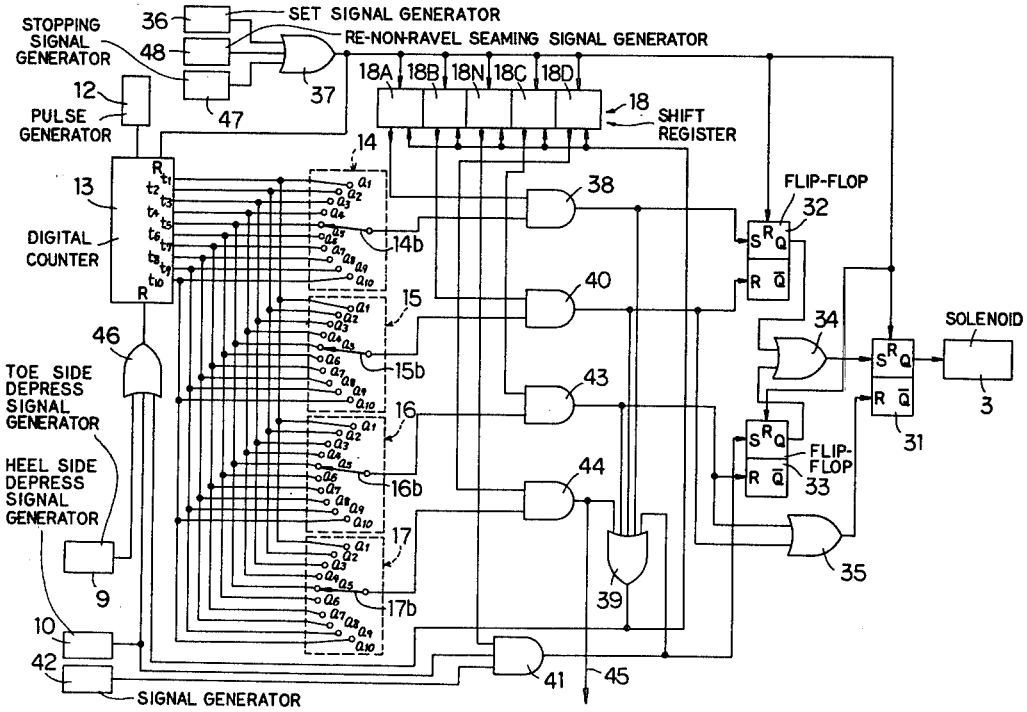

12 Claims, 8 Drawing Figures